United States Patent [19]

Langon

[11] Patent Number: 4,605,481

[45] Date of Patent: Aug. 12, 1986

[54] MODULAR CATHODIC BLOCK AND CATHODE HAVING A LOW VOLTAGE DROP FOR HALL-HEROULT ELECTROLYSIS TANKS

[75] Inventor: Bernard Langon, Saint Jean de Maurienne, France

[73] Assignee: Aluminium Pechiney, Paris, France

[21] Appl. No.: 738,781

[22] Filed: May 29, 1985

[30] Foreign Application Priority Data

Jun. 13, 1984 [FR] France ..... 84 10557

[51] Int. Cl.[4] ..... C25C 3/00

[52] U.S. Cl. ..... 204/243 M; 204/243 R; 204/290 R; 204/294

[58] Field of Search ..... 204/294, 243 R, 243 M, 204/244, 290 R

[56] References Cited

U.S. PATENT DOCUMENTS 3,764,509 10/1973 Etzel et al. ..... 204/243 R 4,076,610 2/1978 Bizzarri ..... 204/243 R

*Primary Examiner*—R. L. Andrews

*Attorney, Agent, or Firm*—Dennison, Meserole, Pollack & Scheiner

[57] ABSTRACT

The invention relates to a carbonaceous cathodic block having a low voltage drop, which is intended for tanks for the production of aluminium by electrolysis using the Hall-Heroult process, said tanks comprising a parallelepipedic metal casing supporting a cathode on which the layer of liquid aluminium is formed, said cathode being formed by the juxtaposition of parallelepipedic carbonaceous blocks of elongate shape wherein the ratio of the length of the major axis to the width is at least equal to two and in which there is cut at least one groove into which is sealed a steel bar which is disposed in parallel relationship to the short side of the casing and which connects to at least one cathodic collector, characterized in that the sealing grooves are cut in the direction perpendicular to the major axis of the block which is itself disposed in parallel relationship to the long side of the casing.

10 Claims, 8 Drawing Figures

FIG. 1
PRIOR ART
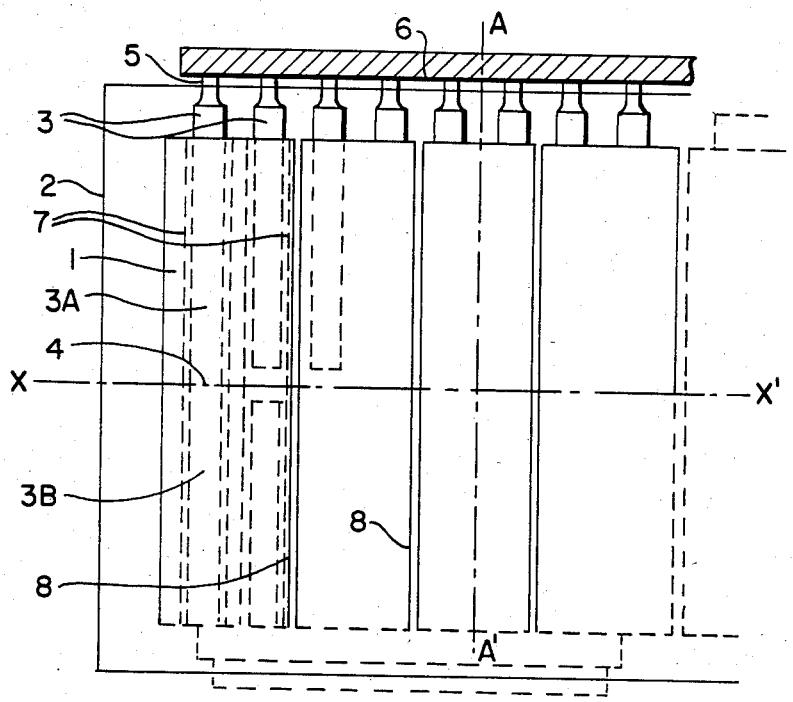
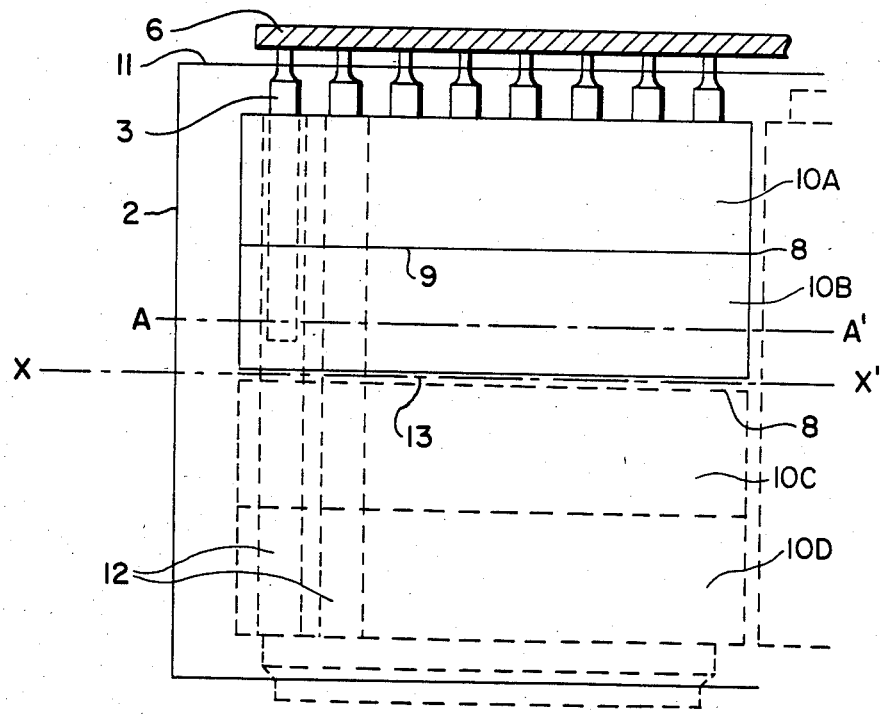
FIG. 2

MODULAR CATHODIC BLOCK AND CATHODE HAVING A LOW VOLTAGE DROP FOR HALL-HEROULT ELECTROLYSIS TANKS

The present invention concerns cathodic blocks having a low voltage drop, which are intended for tanks for the production of aluminium by the electrolysis of alumina which is dissolved in molten cryolite, using the Hall-Heroult process. It also concerns cathodes formed from such modular cathodic blocks.

STATEMENT OF THE PRIOR ART

The cathode of a Hall-Heroult electrolysis tank is formed by the juxtaposition of an assembly of carbonaceous blocks which at their lower base are provided with one (or sometimes two) open grooves into which steel bars of square, rectangular or circular section are sealed, generally by casting iron therein, the connecting conductors between the successive tanks forming a series being connected to the steel bars. The blocks are generally joined by a carbonaceous paste referred to as a luting or brasquing paste which is a poor conductor of current and which is several centimeters in thickness.

The paste must be impervious with respect to the liquid aluminium which is deposited by electrolysis upon the carbonaceous blocks. Therefore, the electrical current flows in the following order through a layer of liquid aluminium, a carbonaceous portion, the bar-block sealing means and the steel bars, and passes into the conductors for connection to the following tank.

Each combination of materials results in a contact overvoltage which depends on the condition of assembly and the surface areas involved. That is particularly true in regard to the contact between the carton component and the sealing means, which is referred to as the sealing means contact.

The total voltage drop may therefore be broken down into three predominant components:

the voltage drop in the carbon, the voltage drop at the sealing means, and the voltage drop in the steel bar.

In order to reduce that voltage drop, it is known to use carbonaceous blocks of low electrical resistivity.

At the present time, most of the producers of cathodic blocks are proposing blocks which are referred to as "semi-graphite" blocks, being produced from a carbonaceous paste in which grains of anthracite have been replaced by grains of graphite, and "semi-graphited" blocks which are produced from a conventional carbonaceous paste but with baking at elevated temperature (>2000° C.) so as to cause partial graphitisation of the block in the mass thereof. That substantially increases the electrical conductivity of the blocks. However, that type of block suffers from the defect of increasing electrical current distortion in the upper layer of liquid aluminium as a result of more severe inclination of the lines of current in the liquid aluminium, hence increasing magnetic turbulence of the other layer of liquid aluminium, which detrimentally affects the hydrodynamic stability of the electrolysis apparatus.

In order to correct that defect, it is possible to use the construction referred to as "sandwich blocks", in which a portion is formed for example from carbonaceous paste with anthracite grains and another portion is formed from semi-graphite or semi-graphited carbonaceous paste, with a higher level of electrical conductivity.

In order to increase the active surface area of the cathode, it has also been proposed that the method which involves joining the blocks by means of a luting or brasquing paste (which is a poor electrical conductor) should be replaced by glueing by means of a conductive glue based on graphite and thermosetting resins. That procedure has the quadruple advantage of increasing the total conductive surface area, permitting electrical transfers between two adjacent blocks, reducing the emission of tars when the carbonaceous joining material is set in position, and improviding the imperviousness of the assembly.

In order to reduce the total voltage drop, it is also known to increase the section of the steel bar, at least in the region thereof which is sealed into the carbon, while retaining a normal or reduced section at the point at which the bar passes through the outside portion of the thermal insulation of the tank, in order to avoid excessive thermal leakage.

However, the extent of such an action is necessarily limited as the thickness of carbon forming the side portions of the groove must be sufficient mechanically to resist the stresses due to thermal expansion of the cathodic bar and the sealing means thereof, when the tank is being brought into operation. The shape of the section of the sealed portion may be either circular or rectangular.

In order to reduce the voltage drop, use is also made of carbonaceous blocks having two narrow grooves, which have the advantage of multiplying the contact surface area with respect to the sealing means, without making the block too fragile when it is subjected to the thermal operating stresses of the electrolysing apparatus. It is then necessary to provide a minimum spacing between the edge of the block and the closest groove, and that limits the possible cross section of the steel bars.

Irrespective of the construction adopted and irrespective of the shape and dimensions of the blocks and the iron bars which are sealed into the blocks, the cathode is always constructed by arranging the blocks in parallel relationship to the small side of the metal casing so that the cathodic outputs (ends of the bars which extend to the exterior of the casing and to which the inter-tank connecting conductors are connected) are always on the long side of the tank, whether the tanks are disposed lengthwise or transversely with respect to the axis of the series of tanks.

STATEMENT OF PROBLEM

At the present time, producers of aluminium are trying to increase the unit power of electrolysis tanks with a view in particular to increasing the outputs thereof, reducing the capital investment costs, and facilitating integral automation of the operating procedure. The level of 200,000 amperes has already been greatly exceeded, and it is highly probable that a level of 400,000 amperes will be reached before the end of the nineteen eighties.

In parallel therewith, a substantial effort is being made to reduce the levels of power consumption of the tank, in particular by reducing the ohmic drops in the cathode.

The construction of cathodes with a low voltage drop for tanks of that kind of power requires fresh solutions which cannot be achieved simply by extrapolation from the presentday solutions. In fact, it is known that the service life of a tank is closely dependent on the quality of its cathode as most of the occasions on which tanks are prematurely taken out of service are due to metal and electrolyte infiltrating into the sub-cathodic space.

STATEMENT OF THE INVENTION

The present invention is based on a novel design of cathodes which may be referred to as being "modular" as, by acting on the number of modules, it can be adapted to any size of tank which is an integral multiple of the dimensions of the module.

The invention concerns a carbonaceous cathodic block having a low voltage drop, which is intended for tanks for the production of aluminium by electrolysis using the Hall-Heroult process, such tanks comprising a parallelepipedic metal casing supporting a cathode on which the layer of liquid aluminium is formed, said cathode being formed by the juxtaposition of parallelepipedic carbonaceous blocks of elongate shape, having a ratio in respect of the length of their major axis to their width that is at least equal to two, and wherein there is cut at least one groove into which is sealed a steel bar disposed in parallel relationship to the short side of the casing and which connects to at least one cathodic collector, characterised in that the sealing grooves are cut in a direction which is perpendicular to the major axis of the block which is itself disposed in parallel relationship to the long side of the casing.

By virtue of a first cathodic block being associated with at least one second block, by glueing on a large side face thereof, it is possible to produce a cathodic demi-module whose width corresponds to half the width of the cathode.

By associating two demi-modules together by a means such as glueing, it is possible to provide a cathodic module whose width corresponds to the width of the cathode.

The same invention also concerns a carbonaceous cathode for the production of aluminium using the Hall-Heroult process characterised in that it is formed by the juxtaposition in the same plane of at least two cathodic modules, the connection between the successive modules being provided by a known means such as a join of carbonaceous paste.

BRIEF DESCRIPTION OF THE DRAWINGS

FIG. 1 is a plan view of part of a cathode of an electrolysis tank according to the prior art.

FIG. 2 is a plan view of part of the cathode of an electrolysis tank according to the invention.

DETAILED DESCRIPTION OF THE INVENTION

Figure 3:
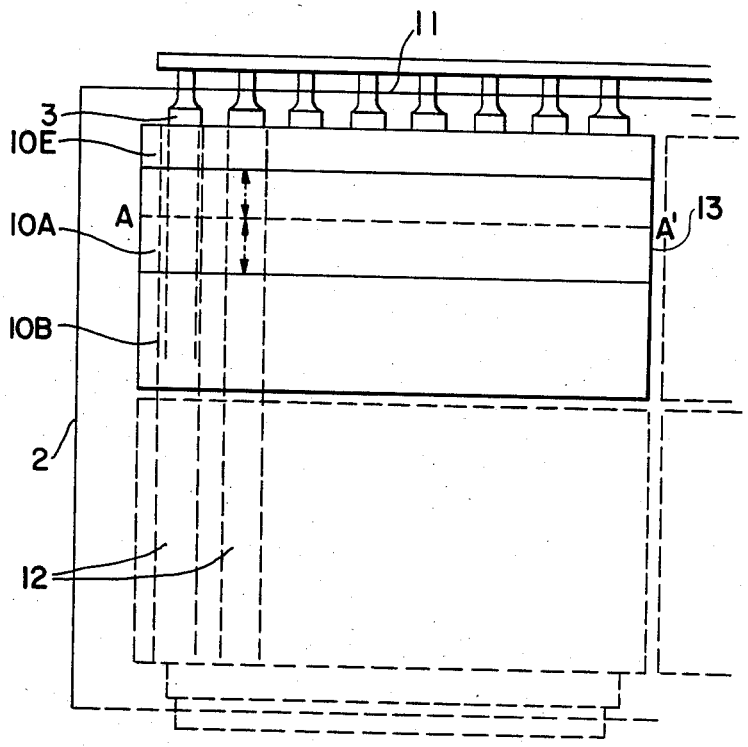
FIG. 3 is a plan view of a part of an electrolysis tank according to an alternative embodiment of the invention.

FIG. 1 is a diagrammatic plan view of part of the cathode of an electrolysis tank, using the presentday construction. The cathodic blocks 1 are disposed in parallel relationship to the short side 2 of the metal casing which supports the cathode of the electrolysis tank. The blocks are of parallelepipedic shape, being elongate with a long or major axis as indicated by AA', the height h and the width l thereof generally being of the order of 300 to 700 mm, while their length is of the order of 2 meters and above. The length/width ratio, in most cases, is higher than 2, and may reach from 4 to 8. Height and width are often in a ratio which is not substantially different from 1.

In the particular construction shown in FIG. 1, each block 1 comprises two bars 3 which in practice are often each formed by two bar halves 3A and 3B which may or may not be contiguous or joined in their central portion 4. At their end 5, on the exterior, the cathodic bars are connected to one or more lateral conductors as indicated at 6, which are connected to the anodic structure of the next following tank in the series. The bars are sealed into one or two longitudinal grooves 7 of the block 1, in most cases by means of cast iron.

The successive cathodic blocks are sealed by a joint formed by luting or brasquing paste 8 which is tamped into position in the hot condition and which seals the assembly of the cathode with respect to infiltrating liquid aluminium and molten electrolyte, the service life of the tank being closely dependent on the sealing effect produced.

In accordance with the invention (as shown in FIG. 2 and the following figures of drawings), the cathodic blocks 10A–D are disposed in such a way that their major axis AA' is parallel to the long side 11 of the casing and to its major axis XX'. The cathodic bars 3 and the outputs 5, as well as the collector 6, are disposed in the same manner, but the grooves 12 are now cut transversely in the cathodic block, parallel to the short side thereof and therefore perpendicularly to its major axis AA'.

Each "cathodic demi-module" is formed by the association of two blocks 10A and 10B which have been previously assembled together by a means such as adhesive as indicated at 9, the cathodic bars being set in position and sealed in place by means of the usual processes such as sealing with cast iron or, more rarely, carbonaceous paste. The juxtaposition of two identical demi-modules symmetrically with respect to the major axis of the tank constitutes a first cathodic module. The two half-modules 10A–10B and 10C–10D are joined together and grouted in the usual fashion using luting or brasquing paste 13 or preferably by adhesive. The grouting operation may be carried out before or after the cathode construction has been set in position in the casing. The first cathodic module is then completed by a certain number of identical modules with are grouted together using the luting or brasquing paste 8, depending on the type of tank. A cathode for a 180,000 ampere tank for example may be formed from three successive modules. Although the foregoing description sets forth demi-modules which are each formed by two blocks, that example does not constitute a limitation on the invention. It is possible to envisage semi-manufactured products formed by two blocks of unequal widths, or three blocks of equal or unequal widths, although in contrast the height and the length must be the same in all cases.

Taking the above-indicated basic principle, the invention can be carried into effect in a plurality of different ways. Each of the two blocks forming a cathodic demi-module, as indicated at 10A and 10B, may be of identical composition, that is to say, produced from the same carbonaceous paste, or of different composition, so as to impart particular properties to one of the blocks, for example a different level of thermal or electrical conductivity.

For example, the outside block 10A may be of conventional type (pitch+grains of anthracite) which, at 900° C., has an electrical resistivity value of the order of $4.4\times10^{-3}$ Ωcm and a thermal conductivity value λ of the order of 0.03 W/cm/°C., whereas the inner block 10B may be of the "semi-graphite" type, which at 900° C. has an electrical resistivity value of $2.8\times10^{-3}$ Ωcm and a thermal conductivity value λ of 0.23 W/cm°C.

In an alternative form as shown in FIG. 3, the outer block 10A may itself be formed in two parts, the outer part 10E being of a material with a relatively low level of thermal conductivity so as to reduce the flow of heat which is drained off to the exterior by the carbonaceous blocks and thus to improve the thermal balance sheet of the electrolysing apparatus.

Finally, the sections of the sealing grooves 12 may all be of equal width or some thereof, in particular those at the ends, may be different, for example in order to provide a constant spacing between the holes in the side wall of the casing, through which the cathodic bars issue.

Moreover, over a part at least of the surface of the cathodic blocks forming the cathode, it is possible to incorporate a substance which enables them to be wetted with the liquid aluminium. Such incorporation may be at the surface or it may involve all or part of the cathodic blocks.

It is known in particular from the publication by K. BILLEHAUG and H. A. OYE, "ALUMINIUM" 56, 1980, pages 642 to 648 (April 1980) and pages 713 to 718 (November 1980) that refractory compounds referred to as "RHM" (Refractory Hard Metals) and more particularly titanium diboride $TiB_2$ are both wetted with liquid aluminium and also subject to very little attack by that metal at temperatures of 930° to 960° C.

Thus, it is possible for the surface of the cathodic blocks to be totally or partially covered with plates or other elements of pure $TiB_2$ or a composite material containing at least 30% of $TiB_2$; alternatively, using known means, it is possible to produce a deposit of $TiB_2$ or a $TiB_2$-base composite over all or part of the cathodic surface; alternatively again, it is possible to introduce $TiB_2$ and/or a RHM compound into the carbonaceous material forming the cathodic blocks or at least the upper portion of the cathodic blocks which is in contact with the liquid aluminium, the proportion of $TiB_2$ or RHM compound being at least equal to 30%, which is the recognised minimum for producing the wetability effect. In that way it is possible to stabilise the layer of liquid aluminium and substantially to reduce the anode-cathode spacing and therefore the voltage drop in the electrolysis bath, which gives a correlated reduction in specific energy in kilowatts hour per tonne of aluminium produced.

ADVANTAGES OBTAINED BY THE INVENTION

A very large number of advantages are attained by carrying the invention into effect, as may be put forward in the following manner:

1. The useful cathodic surface area is increased by replacing joints made up of luting or brasquing paste, from 30 to 40 mm in width and providing poor electrical conductivity, with glued joints of very small thickness, of the order of a millimeter.

2. It is now possible to reconcile a substantial steel section with a substantial carbon-steel contact surfacea area, which was not the case in accordance with the prior art.

It will be seen from FIG. 5 which shows, on a scale of about 1/20, vertical sections of cathodic blocks, in accordance with the prior art as indicated at 5A and 5B, and in accordance with the invention as indicated at 5C, that, for a given vertical section, the dimensions go from a sealing contact length of 36.8 dm and a steel and cast iron section of 17.16 dm2 for the block shown at 5A, to a contact length of 29.2 dm and a section of 26.4 dm2 in the case of block 5B, and to a contact length of 41.6 dm and a section of 25.08 dm2 in the case of the block indicated at 5C. That results in a very substantial reduction in the ohmic sealing contact drop, combined with a very low level of ohmic drop in the steel bar. It should be noted that that overall gain which was found to be equal to several tens of millivolts, was achieved without rendering the carbon block fragile, the wings or side portions 16 of the blocks, that is to say, the carbon portions remaining between grooves or between a groove and the side of the blocks, still being of the same dimensions. The man skilled in the art is aware that a gain of 10 mV is equivalent to a drop in consumption of from 30 to 35 kWh per tonne of aluminium produced.

3. The novel arrangement of the cathodic blocks makes it possible to produce mixed or "sandwich" blocks in a simple and economical fashion. In the prior art, it was necessary to cut up the blocks 1 and then to assemble the two parts (anthracite and semi-graphite for example) when fitting the cathodes, whereas in accordance with the invention, each mixed block such as 10A=10B is produced by simp1y glueing two blocks of standard dimensions and setting them in position as they stand.

4. The positioning operation requires less labour: the fitting of four blocks (FIG. 1) is replaced by the fitting of two demi-modules (FIG. 2) or a single module which has been pre-assembled by adhesive means.

Figure 4A:
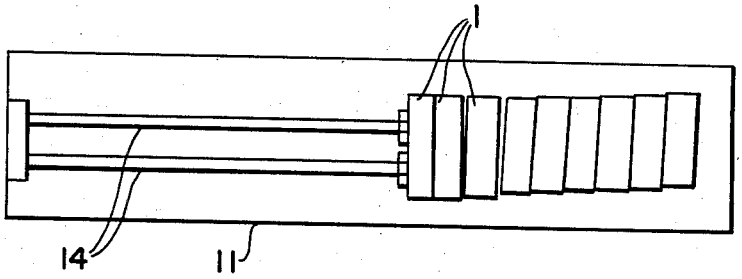
FIG. 4A PRIOR ART
FIG. 4A is a plan view of an arrangement of cathodic blocks in an electrolysis tank according to the prior art.
Figure 4B:
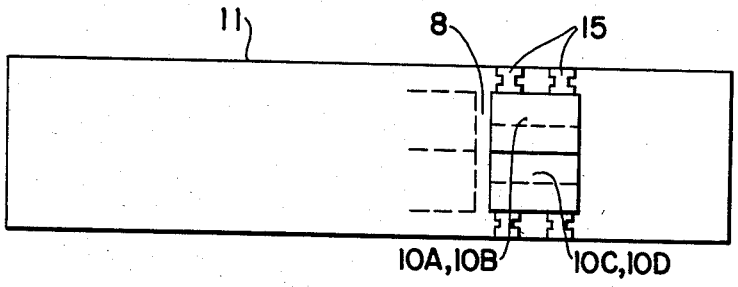
FIG. 4B is a plan view of the arrangement of cathodic blocks in an electrolysis tank according to the invention.

5. In comparison with the conventional way of glueing together blocks 1 in a transverse configuration, being pushed by means of jacks 14 having a long operating travel (see FIG. 4A), being a difficult operation to carry out as that arrangement causes errors in parallelism to become cumulative, the modular assembly of the invention accommodates substantial inaccuracies which are compensated for by the jointing of brasquing or luting paste as indicated at 8 between adjacent modules (FIG. 4B). In addition, it is sufficient to provide jacks 15 which have a short operating travel, being disposed against the long side of the casing, for pushing against the two demi-modules 5C in the course of glueing thereof to form each cathodic module.

6. By replacing the luting or brasquing paste joins by adhesive or glued joins, the cathode is better sealed with respect to infiltrating molten metal and electrolyte. The importance of the properly sealed nature of the cathode has been pointed out hereinbefore.

7. Finally, the invention is compatible with the use of cathodic surfaces which can be wetted with liquid aluminium.

EXAMPLE OF USE

Figure 5A:
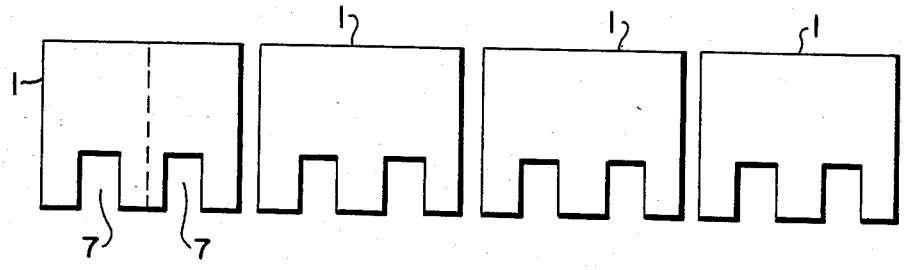
FIG. 5A PRIOR ART
FIGS. 5A and 5B are side cross-sectional views of embodiments of cathodic blocks according to the prior art.
Figure 5B:
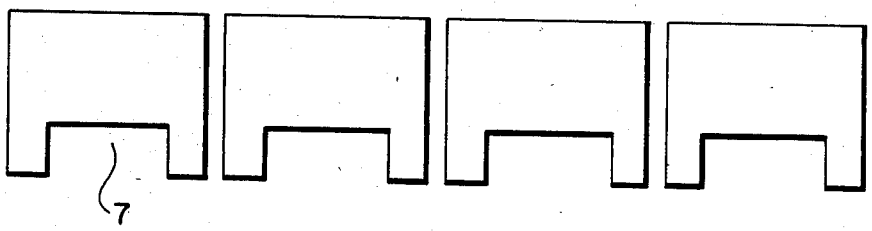
FIG. 5B PRIOR ART
Figure 5C:
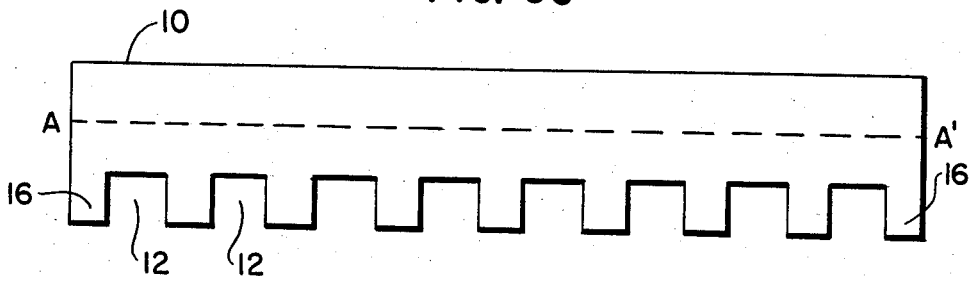
FIG. 5C is a side cross-sectional view of a cathodic block according to the invention.

The invention was carried into practice on a number of tanks of a series operating with a current of 180,000 amperes, with the cathode being formed from demi-modules made up of two "semi-graphite" blocks as shown in FIG. 5C.

Taking coventional tanks with anthracite blocks and taking the tanks which have been modified in accordance with the invention, measurements were taken in respect of the voltage drop in the cathodic system, in the sealing contact and in the cathodic bar, and the results obtained are as follows:

| | PRIOR ART BLOCKS | | ACCORDING TO THE INVENTION | |
|---|---|---|---|---|
| | FIG. 5A | FIG. 5B | BLOCKS | FIG. 5C |
| Sealing contact | 67 | 84 | 59 | |
| Bar ohmic drop | 136 | 88 | 83 | |
| TOTAL | 203 | 172 | 142 | |

The maximum gain achieved is 61 mV, which corresponds to close to 200 kWh less per tonne of aluminium produced. Half of that gain was achieved by using "semi-graphite" blocks with a lower degree of resistivity, while the other half was attained by using the modular cathodic block invention.

I claim:

1. A carbonaceous cathodic block having a low voltage drop, which is intended for tanks for the production of aluminum by electrolysis using the Hall-Heroult process, said tanks comprising a parallelepipedic metal casing having major and minor axes supporting a cathode on which the layer of liquid aluminum is formed, said cathode being formed by the juxtaposition of parallelepipedic carbonaceous blocks of elongate shape having major and minor axes, having a ratio of the length of the major axis to the minor axis which is at least equal to two, and in which there is cut at least one groove into which is sealed a steel bar disposed in parallel relationship to the short side of the casing and the end of which issues at the long side of the casing and connects to at least one cathodic collector, characterised in that the sealing grooves (12) are cut in the direction which is perpendicular to the major axis AA' of the block which is itself disposed in parallel relationship to major axis of the casing.

2. A cathodic block according to claim 1 characterised in that it is associated by glueing a long side face of a first block with the long side face of at least one second block thereby to form a cathodic demi-module whose width corresponds to half the width of the cathode.

3. A cathodic block according to claim 2 characterised in that it is formed by the association of two demi-modules by glueing together a long side face of each to form a cathodic module whose width corresponds to the width of the cathode.

4. A carbonaceous cathodic block according to claim 2 characterised in that each demi-module is formed by blocks produced from the same carbonaceous paste and having substantially identical thermal and/or electrical properties.

5. A carbonaceous cathodic block according to claim 2 characterised in that each demi-module is formed by blocks having thermal and/or electrical properties which are different from each other.

6. A carbonaceous cathodic block according to claim 1 characterised in that all the sealing grooves (12) are of equal width.

7. A carbonaceous cathodic block according to claim 1 characterised in that some of the sealing grooves (12) of the same block are different in width from the others.

8. A carbonaceous cathode for the production of aluminium by electrolysis using the Hall-Heroult process characterised in that it is formed by the juxtaposition in the same plane of at least two modules according to claim 3, the successive modules being connected together by a joint of carbonaceous paste.

9. A carbonaceous cathode according to claim 8 characterised in that incorporated over at least a part of its upper surface which is in contact with the aluminum is a refractory hard metal compound containing at least 30% titanium diboride in a proportion that is at least equal to 30% to make said surface wettable with the liquid aluminum.

10. In a tank for the production of aluminum by electrolysis using the Hall-Heroult process comprising a parallelepipedic metal casing having major and minor axes supporting a cathode on which a layer of liquid aluminum is formed, said cathode being formed by the juxtaposition of parallelepipedic carbonaceous blocks of elongate shape having major and minor axes, having a ratio of the length of the major axis to the minor axis which is at least equal to two, and in which there is cut at least one groove into which is sealed a steel bar disposed in parallel relationship to the short side of the casing and the end of which issues at the long side of the casing and connects to at least one cathodic collector, the improvement comprising disposing said blocks within said metal casing such that the major axis of said blocks is parallel to the major axis of said casing, and disposing said at least one groove in a direction perpendicular to the major axis of said blocks, whereby said blocks have a low voltage drop.

* * * * *